United States Patent [19]

Clarke

[11] 3,990,705

[45] Nov. 9, 1976

[54] DART FLIGHTS

[75] Inventor: Robert L. Clarke, Stansted, England

[73] Assignee: Clarke & Merrifield Limited, Essex, England

[22] Filed: July 18, 1975

[21] Appl. No.: 597,288

[52] U.S. Cl. ..... 273/106.5 C; 273/106.5 R

[51] Int. Cl.[2] ..... A63B 65/02

[58] Field of Search ..... 273/106.5 R, 106.5 C, 273/106 A

[56] References Cited

UNITED STATES PATENTS

| | | | |
|---|---|---|---|
| 3,595,579 | 7/1971 | Benoit | 273/106.5 C |

FOREIGN PATENTS OR APPLICATIONS

| | | | |
|---|---|---|---|
| 531,326 | 1/1941 | United Kingdom | 273/106.5 R |
| 679,970 | 9/1952 | United Kingdom | 273/106.5 R |
| 534,289 | 3/1941 | United Kingdom | 273/106.5 R |
| 584,993 | 1/1947 | United Kingdom | 273/106.5 R |
| 664,850 | 1/1952 | United Kingdom | 273/106.5 C |

*Primary Examiner*—Paul E. Shapiro
*Attorney, Agent, or Firm*—Brisebois & Kruger

[57] ABSTRACT

A dart flight assembly comprises an adaptor one end of which is arranged to be fitted to the body of a dart, at least one thin metal pin which protrudes from the other end of the adaptor, and at least three blades made from folded sheet plastics material spaced around and mounted directly on the at least one metal pin. A dart flight assembly may have a single pin which is threaded between the flight blades at their junction along the axis of the assembly. Alternatively there may be the same number of metal pins as there are flight blades, the pins being arranged substantially parallel to each other and each pin being held in tangential contact with adjacent pins over part of its length, the ends of the pins remote from the adaptor having equiangular spaced flight blades folded from sheet plastics material slid between them so that the blades are prevented from rotating with respect to the pins.

9 Claims, 6 Drawing Figures

DART FLIGHTS

Most darts in current use have a detachable flight assembly which is screwed into a threaded bore in the body of the dart. The flight assemblies usually comprise a cane or bamboo stem inserted into a plastics adaptor which has a screw-threaded spigot for connection with the body of a dart. The flight blades are made from feathers and are glued around the stem. It has recently been found that flight blades prepared from sheet plastics material are a suitable alternative to flight blades made from natural feathers and they are even preferred by some players. This has given rise to flight assemblies in which a cane or bamboo stem is provided with a cruciform slot to receive a four-bladed dart flight. The adaptor and stem have also been made integrally by injection moulding and in this case the slots have been formed in the end of the stem during the injection moulding process. Neither of these approaches is satisfactory when a flight assembly includes three blades made from sheet plastics material.

According to this invention a dart flight assembly comprises an adaptor one end of which is arranged to be fitted to the body of a dart, at least one thin metal pin which protrudes from the other end of the adaptor, and at least three blades made from folded sheet plastics material spaced around and mounted directly on the at least one metal pin.

The flight assembly may include more than one thin metal pin and, in this case, it preferably includes the same number of thin metal pins as there are flight blades, the pins being arranged substantially parallel to each other and each pin being held in tangential contact with the adjacent pins over part of its length, the ends of the pins remote from the adaptor being arranged to allow equiangularly spaced flight blades folded from sheet plastics material to be slid between them so that the blades are prevented from rotating with respect to the pins.

Preferably the, or each, pin is made from springy metal and in this case the flight assembly will not be damaged if the dart is accidentally dropped on to its flight, or if the flight of a dart already in a dart board is struck by a following dart. Thus dart flight assemblies having blades made from plastics sheet material and a stem made from a springy metal are particularly robust. The stems may be made from spring steel but they may also be made from some material that does not rust, for example, phosphorbronze or a beryllium-copper alloy.

The adaptor may be made from a metal, for example aluminium, but preferably it is made from a thermoplastics material and in this case the adaptor may be injection moulded around the metal pin or pins. Preferably the flight blades are folded from a sheet of plastics material in such a way that each blade is formed of two thicknesses of material which are stuck back to back to each other, a fold forming the junction between adjacent blades laying along the axis of the completed flight. When the flight assembly includes only a single pin this pin is inserted into an axial pocket formed at the junction between all the blades and it may be adhered to the flight blades. In this case the flight blades may alternatively be retained on the single metal pin by a head formed on the free end of the pin. In all cases the flight blades are held tightly on to the pin, or pins, and prevented from rotating with respect to it, or them.

The one end of the adaptor which is arranged to engage the body of a dart may have a standard screw-thread so that the slight assembly may replace an existing flight assembly. Alternatively the flight assembly may be arranged to be a push-fit on to the body of a dart as described in our co-pending U.S. Pat. application Ser. No. 597,287, filed July 18, 1975. This application discloses an arrangement in which the interconnection between the body of a dart and its flight assembly is formed by a simple spigot and socket joint. This simple spigot and socket joint may be modified by providing a tapering spigot and a correspondingly tapering socket and the joint may also include an interlocking projection and recess on the spigot and socket. In this latter case the projection and recess snap into engagement when the flight assembly is pushed onto the body of the dart.

Two examples of a dart flight assembly in accordance with this invention both of which may be modified to include three or four flight blades will now be described with reference to the accompanying drawings, in which.

Figure 1:
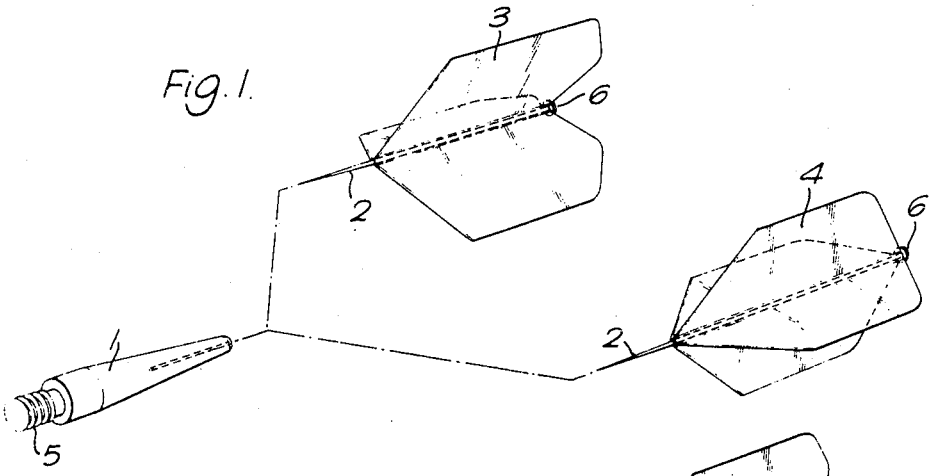
FIG. 1 is an exploded perspective view of the first example showing both modifications.
Figure 2:
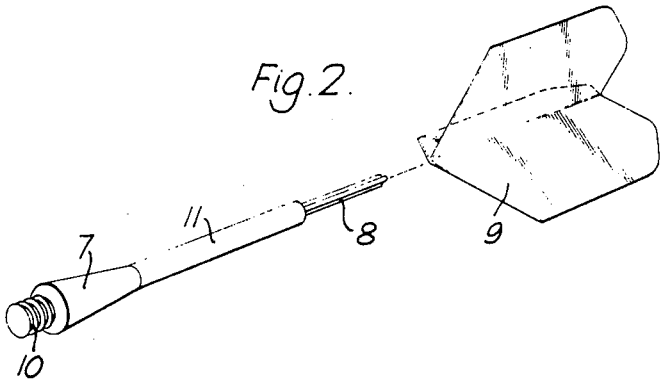
FIG. 2 is an exploded perspective view of the second example.
Figure 3:
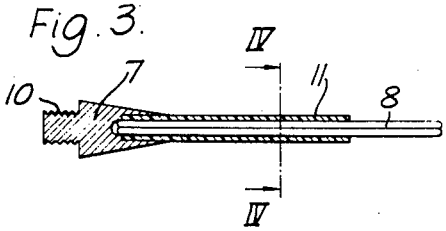
FIG. 3 is a longitudinal section through the second example.

FIG. 1 shows a dart flight assembly comprising an adaptor 1 and a pin 2 with a three-bladed flight 3 or a four-bladed flight 4 attached to it. The flight assembly is provided with either three flight blades or four flight blades and they are merely shown as alternatives for ease of illustration. The front end of the adaptor 1 includes a screw-threaded spigot 5 which, in use, screws into a screw-threaded socket of a dart body, not shown. The flight blades 3 and 4 are prepared from a sheet of polyester material having a temperature sensitive adhesive coating on one face by a method described in our co-pending U.S. Pat. application Ser. No. 567,803, filed Apr. 14, 1975. In this way a generally Y-shaped blank for the three-bladed flight 3 or a generally cruciform blank for a four-bladed flight 4 is folded so that each blade of the flight is formed by two thicknesses of the polyester material which are stuck together back to back, a fold forming the junction between adjacent blades lying along the axis of the completed flight blades. The fold between adjacent blades has a slight curvature so that there is a pocket formed along the axis of the folded flight blades. The pin 2, which in this example includes a head 6 is then pushed into this pocket until the head 6 engages the rear of the flights 3 and 4.

The adaptor 1 is injection moulded about the forward end of the pin 2. To achieve this the adaptor 1 is made from a thermoplastics material, for example polyethylene or polypropylene. When the pin 2 is inserted in the pocket of the flight blades 3 or 4 and is tightly held by the flight blades 3 or 4 so that they cannot rotate on the pin 2. The pin may however be adhered to the flight blades 3 and 4 and in this case the pin is preferably inserted during the folding operation of the flight blades so that when the flight blades are heated to cause the temperature sensitive adhesive on the adjacent portions of the polyester material to bond the adjacent portions together the pin is also bonded to the polyester material of the flight blades.

The second example of a flight assembly includes an adaptor 7, three pins 8 and three flight blades 9. The flight blades 9 are again folded from polyester sheet material having an adhesive coating on one side and the adaptor 7 is made from aluminium but it may also be moulded from thermoplastics material. The adaptor 7 includes a screw-threaded spigot 10 for connection with a screw-threaded socket in the body of a dart. The three pins 8 are formed from eighteen or twenty gauge spring steel wire. The three pins 8 are surrounded by a plastics sleeve 11 over part of their length and are arranged in tangential contact with each other. The sleeved part of the pins is inserted in a bore in the end of the adaptor 7.

Figure 5:
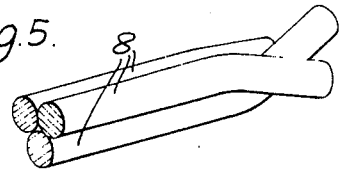
FIG. 5 is a detail of the end of the pins of the second example.
Figure 4:
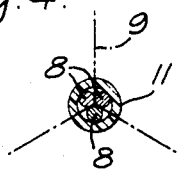
FIG. 4 is a cross-section taken on the lines 4—4 of FIG. 3.

The ends of the pins remote from the adaptor are shown in detail in FIG. 5. One of the pins is longer than the other two and this longer pin is bent towards the other two pins. The ends of the other two pins are splayed apart and are also bent towards the longer pin, the longer pin nesting between the splayed ends of the other pins. This arrangement of the ends of the pins not only makes it easier to insert the three flight blades 9 between the free ends of the pins but it also ensures that the flight blades 9 are gripped by the free ends of the pins 8. The position of the flight blades 9 with respect to the pins 8 is best shown in FIG. 4 where the position of the flight blades 9 are shown in chain-dotted lines. It has been found that the flight blades 9 remain in place between the pins 8, especially when these are formed as shown in FIG. 5 and made from springy metal but, if required, the flight blades 9 may of course be adhered to the pins 8.

Figure 6:
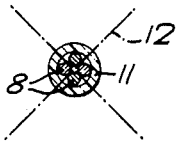
FIG. 6 is a cross-section similar to FIG. 4 but showing a modification of the second example.

This second example may be modified to accommodate four flight blades by providing an extra pin 8. A cross-section through such a modification is shown in FIG. 6 and the position of the four flight blades is indicated by the chain-dotted lines 12. The adaptor 1 may also be manufactured from metal, and in this case the pin 2 is received in a bore formed in the rear end of the adaptor 1. The pins 2 and 8 may, of course, be fixed into the bores in metal adaptors by an adhesive.

I claim:

1. A dart flight assembly comprising an adaptor, one end of said adaptor being shaped to be fitted to the body of a dart, at least three thin metal pins protruding from the other end of said adaptor, at least three flight blades, there being the same number of flight blades as of said metal pins, and means holding each of said pins in tangential contact with the adjacent pins over part of its length, said flight blades being equi-angularly spaced and positioned between the ends of said pins remote from said adaptor, whereby said blades are prevented from rotating with respect to said pins.

2. The dart flight assembly of claim 1 in which there are four metal pins and four flight blades.

3. The dart flight assembly of claim 1, further comprising a sleeving made from a thermoplastics material sheathing said pins between said adaptor and said flight blades.

4. The dart flight assembly of claim 1, wherein said adaptor is made from a thermoplastics material.

5. The dart flight assembly of claim 1, wherein said adaptor is made of a metal.

6. The dart flight assembly of claim 1, wherein said metal pins are made from spring steel.

7. The dart flight assembly of claim 1, wherein there are three said metal pins, one of said pins being longer than the others of said pins, said ends of said others of said pins being splayed apart and being bent towards said one longer pin, and said end of said one longer pin being bent towards said others of said pins whereby said end of said longer pin is nested between said ends of said other pins.

8. The dart flight assembly of claim 1, wherein said flight blades are folded from polyester sheet material.

9. The dart flight assembly of claim 1, wherein said one end of said adaptor which is shaped to be fitted to the body of a dart is formed as a screw-threaded spigot.

* * * * *